United States Patent [19]

Bozoyan

[11] Patent Number: 4,878,819

[45] Date of Patent: Nov. 7, 1989

[54] OTR SAFETY URINAL PUMPS

[76] Inventor: Edward Bozoyan, 1812 West St., Union City, N.J. 07087

[21] Appl. No.: 181,507

[22] Filed: Apr. 14, 1988

[51] Int. Cl.[4] ..... F04B 7/00

[52] U.S. Cl. ..... 417/514; 417/520; 4/431; 4/453

[58] Field of Search ..... 417/510, 511, 514, 520, 417/443, 444, 445, 328; 4/431, 432, 433, 434, 436, 453, 455, 144.1

[56] References Cited

U.S. PATENT DOCUMENTS

| | | | |
|---|---|---|---|
| 535,241 | 3/1895 | Fischer | 4/453 |
| 2,807,025 | 9/1957 | King | 4/433 |
| 2,815,511 | 12/1957 | Friedman | 4/144.1 |
| 4,164,795 | 8/1979 | Johnson | 4/144.1 |
| 4,595,346 | 6/1986 | Bozoyan | 417/513 |
| 4,678,589 | 7/1987 | Ayres, Jr, | 210/797 |
| 4,792,289 | 12/1988 | Nieratschker | 417/259 |

FOREIGN PATENT DOCUMENTS

| | | | |
|---|---|---|---|
| 3329882 | 3/1984 | Fed. Rep. of Germany | 417/511 |
| 8149 | 3/1986 | United Kingdom | 417/511 |

*Primary Examiner*—Carlton R. Croyle
*Assistant Examiner*—Robert N. Blackmon

[57] ABSTRACT

A tie rod type cylinder valved at its lower plate and having a receiver on its upper plate. A rod-less trunk-like piston containing an inlet valve with a stem projecting out of the cylinder and connected with an actuator. The piston face having an opening acting as a valve seat. A capillary vent tube connecting the top of the cylinder with the mouth of the receiver. When the cylinder is filled to a stop, the actuator is activated, which closes the inlet valve and drives down the stem/-valve/piston and it evacuates the cylinder. A flexible discharge line conveys the liquid into a nearby drain pipe or receptacle.

6 Claims, 1 Drawing Sheet

OTR SAFETY URINAL PUMPS

BACKGROUND OF THE INVENTION

The present application comprises improvements over U.S. Pat. No. 4,595,346, Waterless Urinal Pumps, June 17, 1986.

SUMMARY OF THE INVENTION

This invention relates to reciprocating evacuator pumps, and is particularly directed to Other-Than-Restroom's (OTR) safety urinal pumps.

According to the present invention, as a typical example, there is provided an Other-Than-Restroom's urinal pump, hereinafter referred to as "OTR pump" or simply OTR.

An OTR pump comprises: (a) a tie rod type cylinder valved at its lower plate and having a receiver on its upper plate, (b) a rodless trunk-like piston containing (c) a central inlet valve with a stem projecting out of the cylinder and connected with an actuator, (d) a piston face having an opening acting as a central port, (e) a capillary vent tube (not shown) connecting the top of the cylinder with a disinfectant, (f) a flexible discharge line conveying the liquid into a nearby drain pipe or receptacle. When the cylinder is filled to a stop, the actuator is activated, which closes the central inlet port valve and drives down the stem/valve/piston and evacuates the cylinder.

STATE-OF-ART AND OBJECTS

As the world's population grows, as the cities' homeless population is growing, lack of adequate public restrooms is being salient everywhere in the world. Today's confined windowless restrooms are suseptible to uncleanness, smell, violence, and corrupt sexual and criminal activities.

Washington D.C.'s subway, the "Metro", does not have public restrooms. New York City's subway, the largest in the world, presents a more serious case. In hundreds of substations only a few unsafe and soiled restrooms are sometimes in service.

As a result, puddles and streams of urine are amassing in the most civilized city's stations . . . . The locked restrooms in the filling stations and in the office buildings, the lately developed French toilets, etc. are not positively safe and conveniant for public use.

Nature's most frequent calls are answered by passing urine. Providing discrete OTR urinal pumps on desired sites, separate from pre-existing restrooms, should alleviate said restrooms' problem.

In the present practice, to install a urinal fixture the necessary requirements are (a) an underground sewer pipe, (b) a behind-wall vent pipe, and (c) a water hook up. All of these three items are readily available in a restroom. But when it comes to installing a urinal fixture at another desired place, for example in a bedroom, in a substation, or a place "other than the restroom", then these three requirements may become very hard-to-get, impractical, if not impossible . . . . OTR pumps obivate the first two and sometimes all three requirements. Because the OTRs do not necessarily require underground or behind wall piping, (no water hook up nor electrical hook up) they can be easily installed at any desired place, in any room, at any level, in any yard or vehicle. They can be used in permanent or temporary locations.

During the overhaul of the Statue of Liberty, in May 1986, National Park Service reported that thirty museum photographs were destroyed and the Statue's walls are damaged by the worker's urine. Lack of mobile OTR urinal facilities . . . .

"The National Park Service called in an expert last week to check other damage high on the statue which may have been caused by urine." (*The Record,* Sunday, May 11, 1986)

In addition to the water saving and other features claimed in the prior patent, the OTR, installed in single-person stalls, provides positive and round-the-clock personal security, a personal security which is otherwise impossible or non-affordable.

Therefore the principal object of this invention is to provide discrete and safety urinals for all public facilities, without needing attendants for round-the-clock service.

A further object of this invention is to provide a leakproof urinal pump offering dependable and odor-free service.

A still further object is to provide an evacuator pump, with one operative stroke, can evacuate its pressure chamber and thereby minimize the odor problem.

Other objects and advantages of the present invention will become apparent from the following description of the preferred embodiment taken in conjunction with the accompanying drawings.

BRIEF DESCRIPTION OF THE DRAWINGS

In order that the invention may be more fully understood, one construction of OTR pump, in accordance with the invention, will now be described by way of example, with reference to the accompanying drawings in which.

DESCRIPTION OF THE PREFERRED EMBODIMENTS

Figure 1:
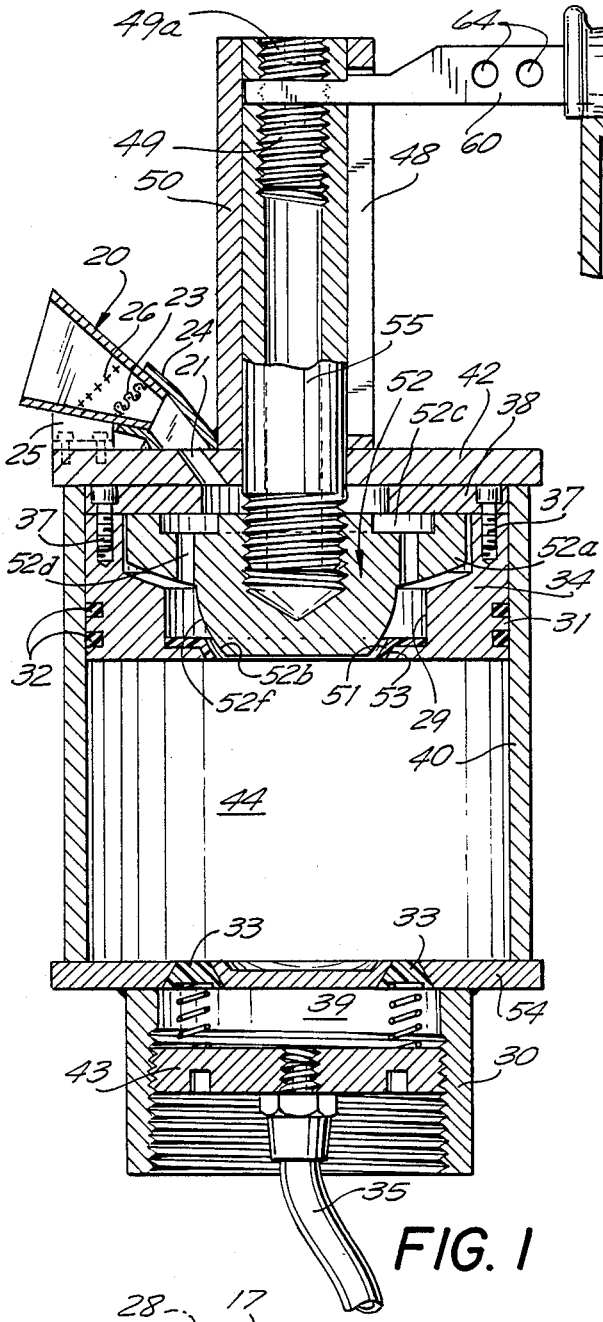
FIG. 1 is a longitudinal section of the improved OTR pumping embodiment which is the major portion of the invention.

Referring now to FIG. 1, numeral 40 indicates a barrel forming a tie rod type cylinder of the OTR pump. Lower plate 54 covers the bottom and upper plate 42 covers the top of barrel 40. Tie rods (not shown) secure the plates and barrel 40 together. Plate 54 has valve seats in its face and spring-loaded outlet valves 33 are lodged in these seats.

A large collar 30 is welded underneath plate 54, which is plugged by plug 43 and the collar forms the discharge chamber 39. Plug 43 has a cross-thru hole wherein is thread mounted flexible discharge line 35. Inside the threads which are lain under plug 43, a pedestal (not shown) is mounted.

Figure 3:
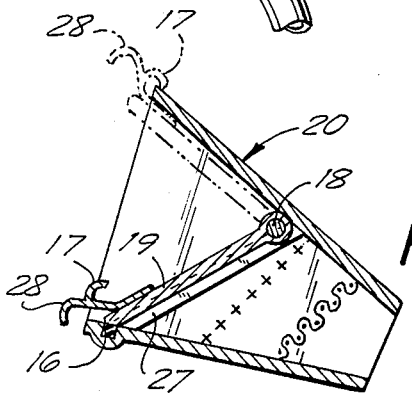
FIG. 3 is a sectional view of the funnel-shaped receiver, partly in elevation, showing the receiver lid in its shut and sealed position; and also showing the lid, in dash and two dots, in its open and latched position.

Upper plate 42 has a central hole and a tubular upright guide 50 is welded on its face and around its hole. On one side of guide 50 there is an elongated slot 48 wherein actuator lever 60 shuttles up and down. Plate 42 has also an inclined hole 21 around which is welded the holder 24. A funnel-shaped receiver 20 is mounted inside the holder 24 having strainer 23, grating 26, sealed shelves 27, floor seal 16 and a lid 19 with hook 17, curled edge 28 for lifting (FIG. 3) and supporting prop 25. Lid 19 is swinging on hinge 18.

Inside barrel 40 is fit piston 34, having rings 32, and annular lid 38 secured with socket head screws 37. In its crown 31 the piston has a large opening, central inlet part 53 covered with seal 51. Under the lid 38 the piston has a large and deep spherical recess and a large interior shelf.

Enclosed inside piston 34 is lodged the central inlet valve 52. On its upper face valve 52 has an annular recess **52*c* and a peripheral rigid flanger 52*a* which has a spherical lower segment. 52*f* is the spherical head of valve 52, and 52*d* are hidden vertical passages connecting recess 52*c* with the lower cavity bore 29 of the piston 34**.

In the central bore of valve 52, threaded-mounted and rigidly secured is the tubular valve stem 55 which is vertically shuttling inside tubular guide 50. Setscrews 49 and **49*a* are provided to reinforce guide 55. Engaging with the sealed seat 53 is the lower surface 52*b***.

For the operation of a full size OTR pump all kinds of electrical, mechanical, electromechanical, pneumatic, etc. actuators can be used. The operational requirement is only about two inches of linear motion. A man-powered actuator is selected for this application to show the cheapest, trouble-free and tamper-proof example. A portion of a spring-return actuator 62 is shown to demonstrate how the actuator is coupled with OTR pump. A spring-opposed, elongated and hollow plunger 62 carries a coiled compression spring 63 and is topped by actuator handle 61. Slider lever 60 is tight fit inside handle 61 and its reduced and cantilever end with two holes 64 is loose fit in stem 55 between setscrews 49, **49*a*. Plunger 62 has a fixed, elongated and lubricated cylinder that attaches with barrel 40 (not shown). Plunger 62 also has a lower actuating pedal (not shown) for use in conjunction with handle 61**.

DESCRIPTION OF OPERATION

In the operation of this device, at the intake cycle, the user directs his urine into the funnel-shaped receiver 20, from where it pours into passageway 21, central opening of closure 38, through annular recess **52*c*, drilled passage 52*d*, the large space around spherical valve face 52*f* and then through open valve 52*b* passing down to fill inside pressure chamber 44**.

Figure 2:
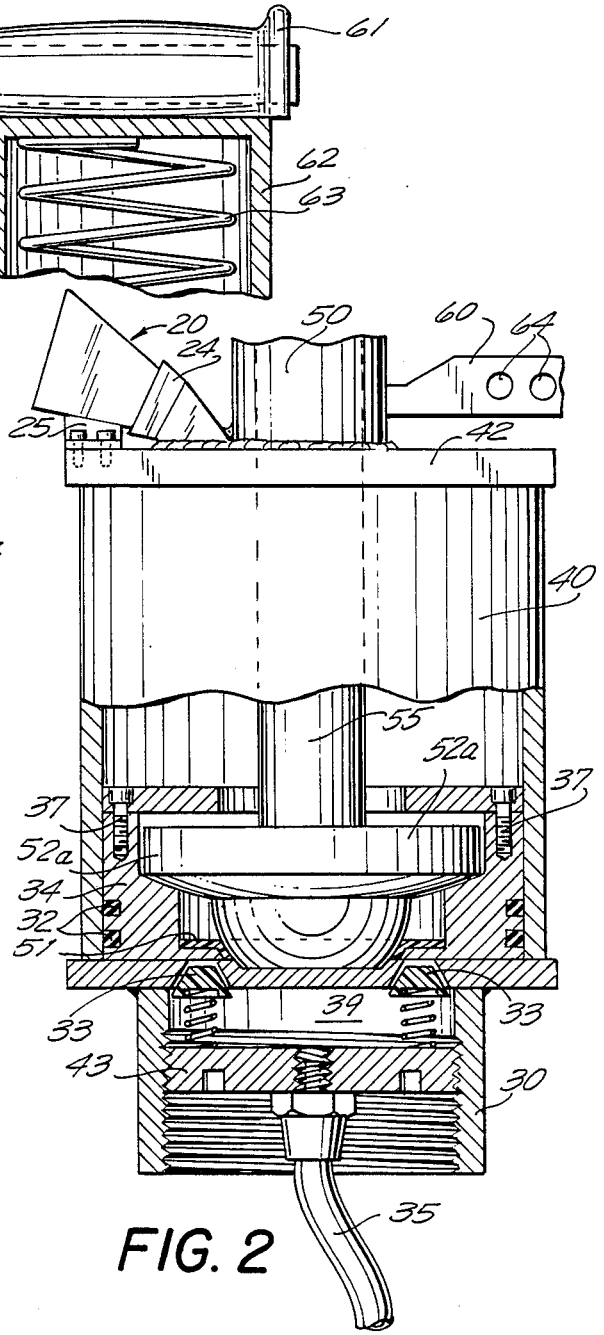
FIG. 2 is a front elevational view of the device of FIG. 1, partly in section, shown in its fully discharged position.

When the user is finished passing water, he pushes down on handle 61 with his hand and at the same time pushes on the actuating pedal (not shown) with his foot. This powerful hand-and-foot depression makes plunger 62 and lever 60 slide down and depress tubular stem 55. As soon as stem 55 moves down, it moves down central valve 52 which at once closes the port 53 by engaging seal 51. About the same time, the lower face of segment **52*a* strikes the interior shelf of the piston 34 (FIG. 2) and thus the central valve 52 depresses and drives the piston assembly 34** all the way down.

The liquid inside chamber 44, full or at any lower level, with the air above its level, starts to be pressurized. Upon continuous downward motion the pressure of air/liquid constrains to open outlet valves 33, filling chamber 39 and pushing the liquid inside flexible discharge line 35 which conveys the fluid into the nearest drain pipe or receptacle, and thus at the bottom of the downstroke, chamber 44 is thoroughly evacuated.

It is to be noted that discharge valves 33 are arranged and positioned to have no fluid pockets between the piston and the valves.

Now the user releases the handle 61 and the pedal. The compressed spring 63 pushed up the whole mechanism; **52*b* is unseated immediately and any liquid, if by-passed over piston closure 38**, starts to flow under the piston. There will be no external leak, no matter how much the piston, its rings, or its valve are worn or deteriorated. For this reason, this device is also called "Leakproof Pump".

In the drawings receiver 20 and slider lever 60 are shown on opposite sides for simplicity reason. However, in practice, they are disposed side by side. The vacant space on top of plate 42 and over receiver 20 and guide 50, may accomodate a disinfectant tank. Each time lid 19 (FIG. 3) is shut down a special valve may be tripped to let a few ounces of disinfectant or water spray inside receiver 20, the latter flowing down and rinsing all the passages and gathering at the bottom of chamber 44. This liquid stays in chamber 44 and seals the top of valves 33, thus no fumes or odor can escape from chamber 39. The disinfectant remains in the chamber until the next use.

It is important to note that a fixture working by water flushing, as in the present practice, definitely requires, a vent pipe, which is usually located behind walls, and also definitely requires, vertically downward discharge which leads to an upper floor sewer pipe, then, of course, a water hook up.

The annular segment of piston crown 31, which forms the port 53, is not made solid. After reaching the pressure limit the seat retracts a few thousands of an inch until **52*a* strikes the shelf of piston 34. The downstroke takes place by 52*a*. The retraction of port 53** is to protect the valve head and its seat from over pressure.

Using an OTR pump obviates these definite requirements, no vent pipe and no underfloor pipe. The flexible discharge line may be run horizontally or diagonally for some distance, then run down in a half inch drilled hole to join the nearest sewer pipe. Therefore OTR pumps may be installed at any desired place readily and inexpensively. Also flushing devices need abundant water supply; thus water pipe, water hook up and valves are necessary. OTR virtually obviates the water need, by using a disinfectant tank. This central valve 52 is acting as the final mover to the pumping device.

To provide round-the-clock personal security, without attendants, in today's public facilities, is like performing a miracle. It is a dream . . . .

OTR urinal pumps arranged and installed inside small "safety stalls" can accomplish said dream.

The "safety stalls" are made vandal-resistant. They are so designed that no second person can fit in them. They can be quickly installed at any desired place; sidewalk, room, office, etc. Wash basin, mirror, towels or toilet paper are relocated in auxiliary small booths. Therefore chances of violence, crime and gatherings are not possible.

Also it is to be noted that OTR pumps evacuate their pressure chamber by one operative downstroke; virtually all the liquid is pumped out. Thus the problem of odor is greatly reduced; a few ounces of disinfectant or water rinses the inside of the pump, then covers the outlet valves. Most of all when the lid of the receiver is shut and sealed, no odor will be emitted.

The invention having been described, what is claimed is:

1. A pouring liquid pumping device connected to an actuating means, to a discharge and disinfectant means, said pump having an "at rest" position, an intake cycle and a pumping cycle; said device comprising:

pressure chamber means having a pump cylinder provided with a lower plate having a valved outlet opening, and having with an upper plate having a central opening and an intake opening;

piston means having a composite piston, said piston having a face on a lowermost surface of the piston with a central opening on said face forming a valve seat; having an interior chamber with an interior shelf and an annular lid covering said interior chamber;

a central and normally open inlet valve operatively disposed inside said piston's interior chamber, said valve having (a) a valve head adapted to engage with and to seal said valve seat provided in the piston;

(b) a rigid peripheral shoulder adapted to operatively drive said piston to and fro, (c) an apertured segment connecting said peripheral shoulder and said valve head, (d) a valve stem projecting out of said piston, out of said cylinder and operatively engaging with said actuating means;

said central valve being the final mover of said pumping device at said intake cycle, liquid is poured down through said intake opening, passed said apertured segment and said valve seat and filled into said pump cylinder; at said pumping cycle, said valve stem and the inlet valve being depressed; at a few millimeters downstroke said valve head strikes and seals said valve seat, at the same time said peripheral shoulder strikes said piston's interior shelf and drives it down, thus the inside liquid is compressed and pumped out through said valved output opening.

2. A pouring liquid pumping device connected to an actuating means, to a discharge and disinfectant means, said pump having an "at rest" pouring position, and a pumping cycle; said device comprising of:

a pressure chamber means, having a pump cylinder, inlet and discharge means, a hollow piston means, disposed inside said cylinder, and having a central opening on a lowermost face forming an inlet port, a central and normally open inlet valve means, connected to said actuating means, having a valve head, an apertured segment and a peripheral flange, operatively disposed inside said hollow piston, said central valve means being the final mover of said pumping device, pouring liquid enters and fills in under said piston "at rest" pouring position, said central valve depresses the piston all the way down, said liquid is pumped out through said discharge means and said cylinder is evacuated, and having an upper plate having a second central opening wherein said upper plate having a tubular valve guide fastened around said second central opening, with said guide protecting and guiding said valve stem, the end of said valve stem having a slot, one side of said guide having an elongated aperture, said actuating means having a slider lever one end of said lever being accommodated in said stem slot and working in said elongated aperture, said slider lever being the control element to drive said stem/valve/piston assembly down and to drive same assembly up.

3. A device of claim 2, wherein said hollow piston having an interior shelf and an annular lid covering its interior chamber, said central valve having a rigid peripheral flange adapted to operatively engage said piston's interior shelf and at the same time said valve head seats and seals said hollow piston's inlet port said valve flange being operatively driving said piston to and fro.

4. A device of claim 3, wherein said pumping device and said discharge members being arranged and constructed to pump out substantially all the liquid under said piston and evacuate said pump cylinder through one operative downstroke without having fluid pockets between the piston and said discharge members.

5. A device of claim 2, wherein said actuating means having an actuator mechanism said pumping device being coupled with said actuator, the pumping device being operated by the actuator all the time: said stem/valve/piston assembly being driven down by the actuator and said assembly being driven up by the actuator.

6. A device of claim 5, wherein said pumping device being attached to said actuator mechanism.

* * * * *